United States Patent [19]

Rief

[11] Patent Number: 4,920,599

[45] Date of Patent: May 1, 1990

[54] AUTOMATIC SWIMMING POOL CLEANER

[75] Inventor: Dieter J. Rief, Rohnert Park, Calif.

[73] Assignee: Pooltec Establishment, Lemgo, Fed. Rep. of Germany

[21] Appl. No.: 273,279

[22] Filed: Nov. 18, 1988

[30] Foreign Application Priority Data

Aug. 20, 1988 [DE] Fed. Rep. of Germany ..... 88113599
Oct. 18, 1988 [DE] Fed. Rep. of Germany ..... 88117338

[51] Int. Cl.[5] ..... E04H 3/20
[52] U.S. Cl. ..... 15/1.7
[58] Field of Search ..... 15/1.7; 134/18, 21

[56] References Cited

U.S. PATENT DOCUMENTS 3,229,315 1/1966 Watson ..... 15/1.7
4,560,418 12/1985 Raubenheimer ..... 15/1.7 X

FOREIGN PATENT DOCUMENTS 2612043 9/1977 Fed. Rep. of Germany ..... 15/1.7
6912499 1/1971 France .

*Primary Examiner*—Edward L. Roberts

*Attorney, Agent, or Firm*—Brooks Haidt Haffner & Delahunty

[57] ABSTRACT

A suction head for the cleaning of submerged surfaces, in particular the bottoms of swimming pools, comprises a drive mechanism which is driven by a water-driven turbine in turn driven by a stream of water drawn through the suction head by an external suction pump via a tube connected to the suction head for removing debris from the surface to be cleaned. The suction head is provided with a self-steering mechanism connected to the drive mechanism to be driven thereby and adapted to change the direction of movement of said suction head upon striking an obstacle, e.g. a swimming pool wall. The turbine comprises a turbine wheel located at the separation line of and within a two-part turbine housing held closed by releasable elastic locking means and which may be easily opened for maintenance, making the turbine wheel readily accessible. Inlet and outlet of the turbine housing are situated in a line defining a chord with respect to the rotary circle of the turbine wheel.

20 Claims, 8 Drawing Sheets

AUTOMATIC SWIMMING POOL CLEANER

The invention relates to an automatic swimming pool cleaner and in particular to the suction head of such cleaner for the cleaning of submerged surfaces.

The U.S. Pat. No. 3,229,315 describes a suction head of an automatic swimming pool cleaner whose front part is of an approx. triangular shape and whose rear part is of an approx. semi-circular shape and directly adjoins the front part. A connecting pipe to be connected to a suction tube is located at the upper side of the suction head in the centre of the semi-circular rear part. The suction head has two rear wheels, which have a relatively large distance to each other in lateral relationship and two front wheels which are fastened to a joint rotary head and have a comparatively small distance to each other. A turbine is disposed in the suction head with vertical rotational axis above the rotary head, which drives the two front wheels via a gearwheel mechanism. There is a suction nozzle below the rear part of the suction head, from which a relatively sinuous spiral flow path leads first of all upwardly, then horizontally to the front, through the turbine and then backwardly and upwardly to the connecting pipe. The suction head housing consists of an upper part with downwardly suspended outer circumferential walls and an intermediate bottom fastened thereto at a distance to the upper wall of the upper part, the turbine housing being formed in the interspace between the upper wall of the upper part and the intermediate bottom and a transmission chamber being formed at the same below the intermediate bottom, in which the gear transmission for driving the front wheel is accommodated.

Due to the twisted flow path this suction head has a relatively high flow resistance to the water sucked in. The transmission mechanism and the turbine are not easily accessible, the entire suction head must rather be disassembled for this purpose, if e.g. these parts must be cleaned.

A suction head for the cleaning of submerged surfaces is known from the German Pat. No. 3,333,633, with a housing which comprises an inlet disposed at its lower side and a rotatable connection element for the connection of a suction tube, which is directed vertically to the lower side, with a water-driven turbine in the flow path of the water flowing through the suction head, with wheels disposed at the housing which support the housing, with movement transmission means between the turbine and at least one wheel and with a second water-driven turbine in the housing which drives the rotatable connection element with alternating directions of rotation via a step-down gear unit so that the suction head, driven by the first-mentioned turbine moves on the surface to be cleaned and, when doing so, describes an arc-shaped path which is defined by the fact that the suction head is rotated about the rotatable connection element by means of the second turbine and thus is rotated about the suction tube. Crawlers are twined about respectively two wheels of the suction head which impart the suction head a relatively large contact area with the surface to be cleaned. The shaft of the first-mentioned turbine is provided with an eccentric weight which transmits a swinging movement to the suction head during operation so that the adhesion of the same to the surface to be cleaned is reduced or forestalled so that too great a resistance is not put up against a change in the driving direction of the suction head. If this suction head is used in a swimming pool and bumps against a vertical wall which delimits the bottom of the swimming pool, then it stops and is rotated by the second turbine about the connection element while standing, whereupon it can continue its drive. However if it drove against a corner in oblique fashion, then it cannot free itself from this position. Since the drive for the rotation of the suction head with respect to the connection element is practically supported on the connection element it is imperative for causing the rotational movement of the suction head that the suction tube is sufficient torsion-proof. This requirement is possibly in contradiction to a sufficient flexibility and a light-weight structure of the suction tube.

A similar suction head for a surface to be cleaned and submerged in water with a suction tube connected to a suction source is known from the German Pat. No. 3,320,923. This suction head does not contain any wheels, but friction legs disposed inclinedly and pivotably on the housing, which cause the housing to move forwardly by vibration upon the actuation by a first water-driven turbine on which an eccentric weight is disposed. The movement path is in turn influenced by a second water-driven turbine and an intermediate gear by means of a rotatable suction tube connecting pipe as in the aforementioned suction head. This suction head behaves like the aforementioned suction head if it bumps against a vertical swimming pool wall.

Due to the fact that the two last-mentioned suction heads are set vibrating, forces act on them which lead to premature wear. Moreover the control mechanism is of a relatively complex nature and—as already mentioned—often unsatisfactory regarding its effect.

The invention is based on the object to indicate a suction head of an automatic swimming pool cleaner which is of simple construction, has a long service life, can be produced with simple tools and can be easily maintained.

This object is attained by a suction head for the cleaning of submerged surfaces, a space in particular the bottoms of swimming pools, which consists of a housing open at the lower side to which at least a front steerable wheel and rear wheels are rotatably mounted, a water-driven turbine disposed in the housing containing a turbine chamber with an inlet opening facing the lower side of the housing, a rotatable connecting pipe traversing the upper side of the housing for connection of a suction tube and a turbine wheel rotatably mounted in the turbine chamber which drives said at least one front wheel via transmission means, wherein the turbine wheel comprises a horizontal rotational axis, the turbine chamber consists of an upper housing part integrally connected to the suction head housing and in which the connecting pipe ends, and a lower housing portion linked to the suction head housing and in which the inlet opening is formed, the lower housing portion being held by a detachable elastic locking means in a position closing the turbine chamber, the axis of the turbine wheel of the turbine being in the separating line of the turbine housing parts so that the turbine wheel is freely accessible when said turbine chamber is opened, and the inlet opening and the connecting pipe are in one line which extends approximately as a chord with respect to the rotary circle of the turbine wheel.

Advantageous embodiments of the suction head, in particular such relating to a self-steering of the suction head upon the bumping against an obstacle are the subject matter of the invention, as well.

The present invention creates a suction head which can be e.g. injection moulded from plastics with injection moulding tools of a simple construction. It only consists of very few elements which are easily accessible and can therefore be cleaned with simple means. In particular the turbine is easily accessible, which would be impaired in its efficiency by foreign substances in the water, because the transmission housing can be opened without the aid of any tools with a simple manipulation and the turbine wheel is then completely exposed so that it can be removed from the turbine chamber and cleaned also without any further contrivances.

The transmission transmitting means between the turbine and the at least one driven front wheel are likewise easily accessible and can be cleaned well.

The assembly of the suction head is substantially carried out by means of catch connections. It is possible to completely avoid the use of screwed or welded connections.

The invention also provides to use a self-steering mechanism at the suction head, which makes a defined drive either straight on or in a curve in rest position possible and leads to a evasive movement of the suction head if it bumps against an obstacle. According to an advantageous embodiment of the invention the rest position can be adjusted by means of a simple eccentric bush to determine the path of the suction head in the case of a drive free from obstacles whether it is to extend straight on, or with a slight or greater curve.

It is not necessary in the invention to set the entire suction head vibrating to facilitate its steerability. The deflection of the suction head from its path upon the bumping against a wall is facilitated by a rotary plate, which is mounted freely rotatably on the front side of the suction head and which projects beyond the contour of the suction head housing at the front and at the side, namely preferably across a curve of at least 180°.

Further advantages and features of the invention are explained in more detail in the following with reference to the drawings.

FIG. 1 shows a perspective contour representation of a suction head according to the present invention.

FIG. 2*a* shows a lateral view, partly as a section, of the suction head according to FIG. 1.

FIGS. 2*b* and 2*c* show details from FIG. 2*a*, partly as a section.

Figure 1:
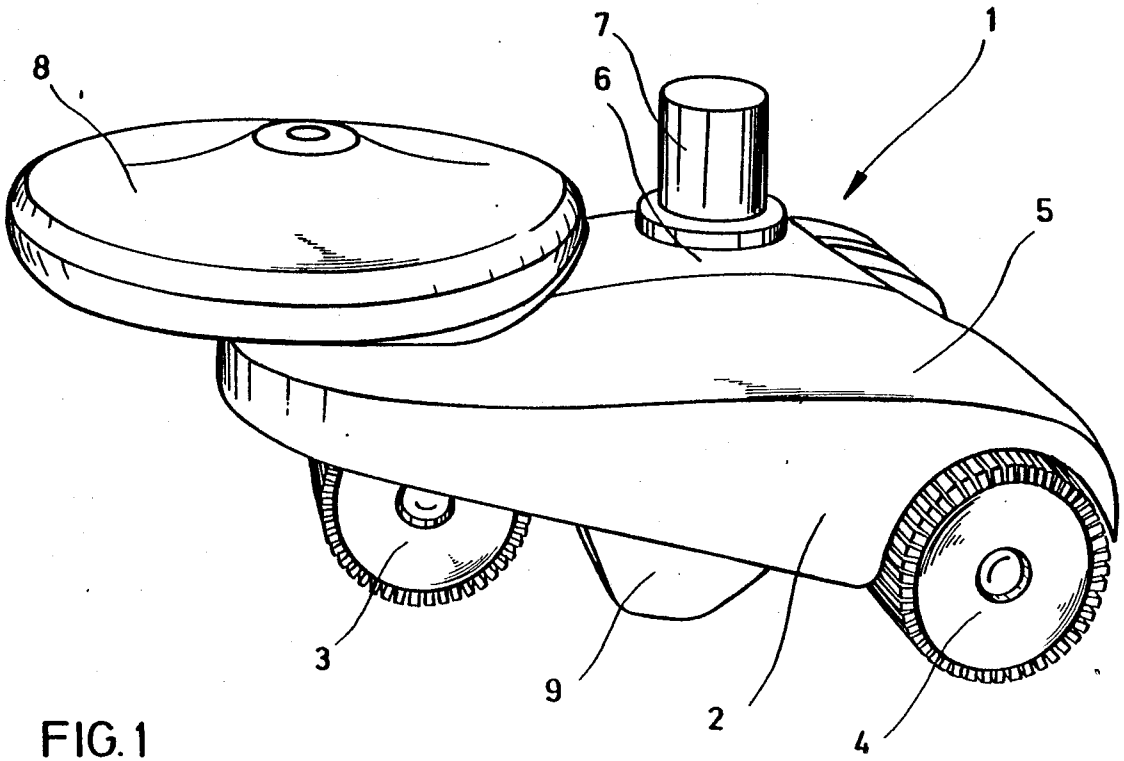

The FIGS. show a suction head which is on the whole designated with 1 and consists of a housing 2 of an approx. trapezoidal contour which is rounded at its front end (cf. FIG. 4) and two closely adjacent front wheels 3 and two rear wheels 4 resting on a joint axle at a larger distance are rotatably mounted. The housing 2 is open at its lower side and at the top closed by a cover plate 5, which has a dome-like prominence in which a connecting pipe 7 for connecting a suction tube (not shown) is rotatably mounted about its axis.

The housing 2 has a recess in its cover plate 5 in the front section, in which a rotary plate 8 is mounted, which is mounted freely rotatably at the housing 2 in a hollow, vertical connecting piece 2*a* integrally formed with the housing. This rotary plate 8 projects beyond the housing 2 at the front and at the side. In FIG. 1 the lateral extension of a suction nozzle 9 can moreover be recognized, which will be described later.

FIG. 1 shows the suction head on a scale being reduced to about half.

The housing 2, the connecting pipe 7, the rotary plate 8 and the nozzle 9 are preferably injection moulded parts, and the rotary plate 8 may possibly consist of two shells, which are joined together at a circumferential edge. The rotary plate 8 has at its lower side a central journal 8*a*, which is plugged into the hollow connecting piece 2*a* at the housing 2 and locked therein behind a projection.

Figure 2A:
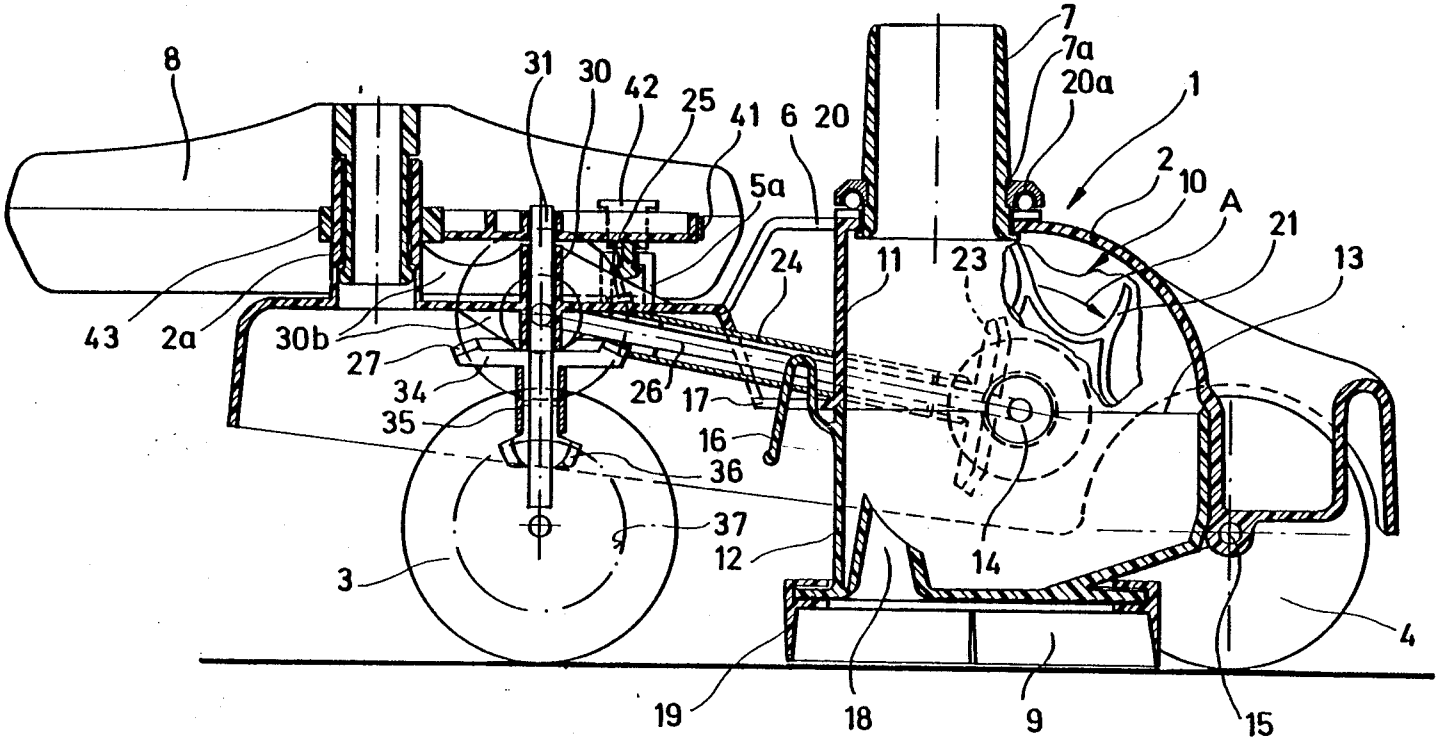

As it is shown by FIG. 2*a* in partially sectioned view a water-driven turbine is disposed in the housing approx. in the rear third, which is on the whole designated with 10. This turbine 10 comprises a turbine housing which is bipartite. The one upper housing part 11 is combined with the suction head housing 1 to an integral unit. The second lower housing part 12 adjoins the upper housing part 11 at a straight separation line 13, the axis of a turbine shaft 14 extending in the separation line 13 and being held there in each case in the one halves of dividable bearings 13*a*. The second lower housing part 12 is pivotably held at an axle rod 15 extending transverely to the suction head housing 2 and fastened in the same, which is at the same time the axle rod for the rear wheels 4. The lower housing element has the second halves of the dividable bearings 13*a* at the separation line 13. An elastic holding means 16 is formed at the lower housing part 12, which holds the lower housing part 12 lockingly by means of a catch 17 formed at the suction head housing in the form of a slot and thus closes the turbine housing and at the same time supports the turbine shaft 14.

The lower housing part 12 has an inlet opening formed at the nozzle 9, which leads into the turbine chamber. The lower housing part 12 widens towards the nozzle 9 which can be recognized in FIG. 1 and supports at the edge an elastic apron 19 which establishes a not completely tight closure to the bottom on which the suction head 1 rolls.

The dome-like prominence 6 of the suction head housing 2 is provided with a circular break-through in which the already mentioned connecting pipe 7 is disposed. It has at its lower end a projecting collar and is inserted through the break-through. It is mounted slightly rotatable abouts its axis at the housing 2 by means of a ball bearing 20. A bearing ring 20*a* forms part of the ball bearing, which is pushed onto the connecting pipe 7 from the top and is locked at the connecting pipe 7 behind a lug 7*a*. The connecting pipe 7 is secured in the break-through at the suction head housing 2 by the aforementioned collar and the bearing ring 20*a*.

Figure 2B:
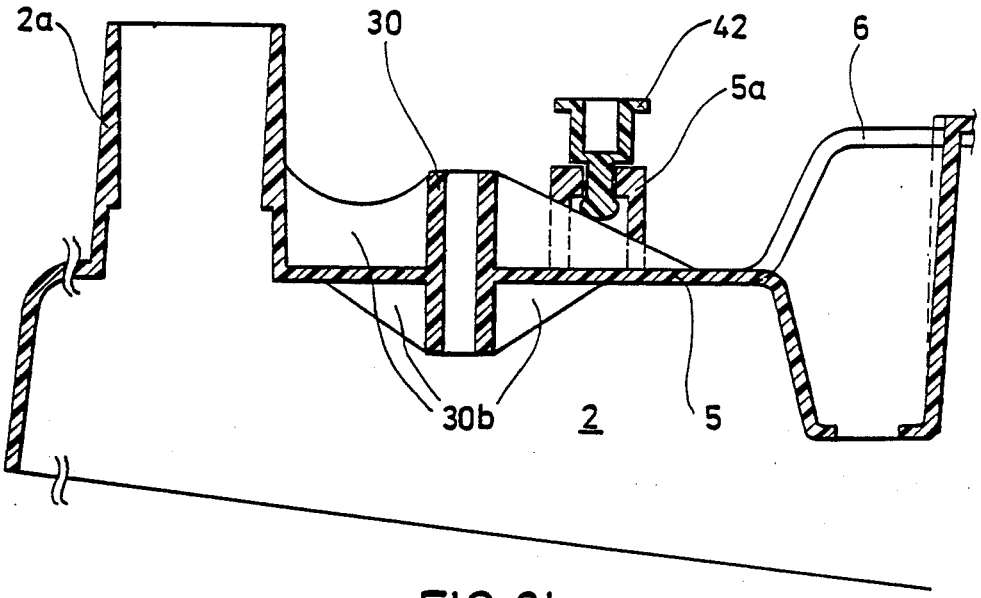
Figure 2C:
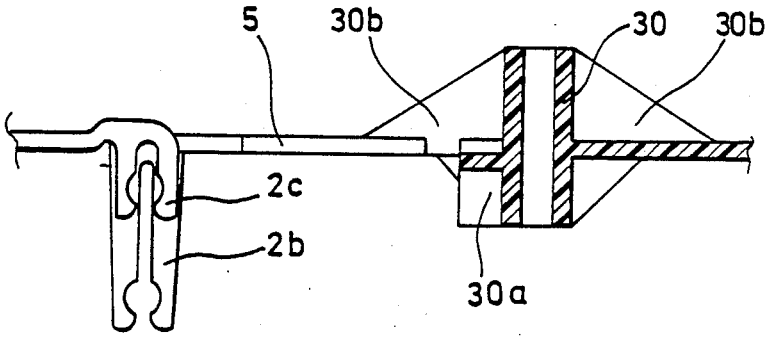

A turbine wheel 21 is rotatably mounted about a horizontal axis in the turbine housing, some blades and the direction of rotation A being recognizable in FIG. 2, which results if a suction effect is exerted at the connecting pipe 7. The turbine wheel 21 and the shaft 14 are designed as integral unit here.

To keep the flow resistance as small as possible the inlet opening 18 of the nozzle 9 and the axis of the connecting pipe 7 are disposed on a straight line, which extends as a chord to the rotating circle defined by the turbine wheel 21 so that during operation a straight-like flow path through the suction head 1 results.

Figure 4:
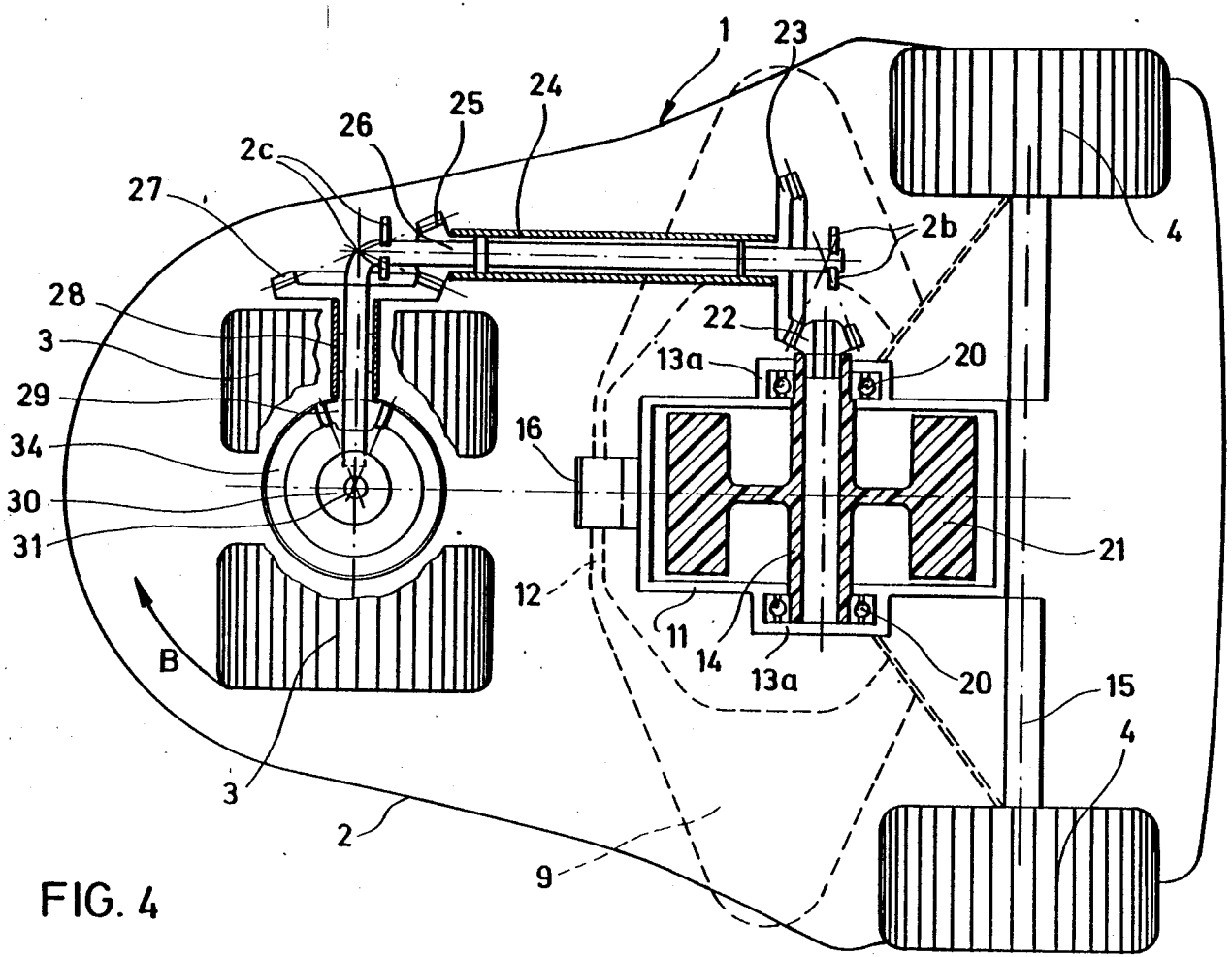
FIG. 4 shows a representation of the suction head from below without rotary plate.

As is shown by FIG. 4 a bevel gearwheel 22 is fastened on the shaft 14 of the turbine wheel supported by the ball bearing 20. It has an axle stub which is inserted into the hollow turbine shaft 14. FIG. 4 shows the nozzle in dotted fashion in the closed condition of the turbine housing. It can be opened together with the lower housing part 12 about the axle rod 15 towards below and above or, if one places the suction head upside down, towards above and the rear so that the turbine housing has then the aspect shown in FIG. 4. One sees that the turbine wheel 21 consisting of shaft 14 and turbine blades is freely exposed and can be easily removed from the suction head 1.

A second bevel gearwheel 23 meshes with the bevel gearwheel 22 fastened to the shaft 14 of the turbine wheel, whose axis of rotation extends approx. in longitudinal direction of the suction head 1. This second bevel gearwheel 23 is connected to a third front bevel gearwheel 25 by means of a sleeve 24 in a manner as to transmit rotation. The second and the third bevel gearwheels 23 and 25 are rotatably supported by a bent axle rod 26 whose one leg traverses the two bevel gearwheels 23 and 25 and the sleeve 24. This axle rod 26 is held in the suction head housing 2 by means of elastic, fork-like fastening tabs **2*b* and 2*c* (cf. FIG. 2*c*) which are integrally formed with the housing 1. The one fastening tabs 2*b* are disposed near the one end of the axle rod, while the other fastening tabs 2*c* are disposed near the point where the axle rod 26 is bent. The axle rod 26 extends from the rear second bevel gearwheel 23 to the front third bevel gearwheel 25 in slightly upwardly inclined fashion as shown by FIG. 2*a*. The axle rod 26 is rectangularly bent at its front end and has supported on the bent second leg a fourth bevel gearwheel 27 which is connected to a fifth bevel gearwheel 29 by means of a sleeve in a manner as to transmit rotation. The bent second section of the axle rod 26 extends approximately in horizontal direction. Its free end is fixed in a pocket 30*a* (FIG. 2*c*) which is integrally formed with the suction head housing 2**.

The pocket **30*a* is formed laterally at an approx. vertically extending bush 30 in which a rotary rod 31 is rotationally mounted. The pocket 30*a* may be closed by a plug at the lower side to secure the axle rod 26 therein. The bush 30 is integrally formed with the suction head housing and reinforced by radial ribs 30*b* at the outside against the suction head housing 2. The bush 30 traverses the upper side of the suction head housing 2**.

Figure 5:
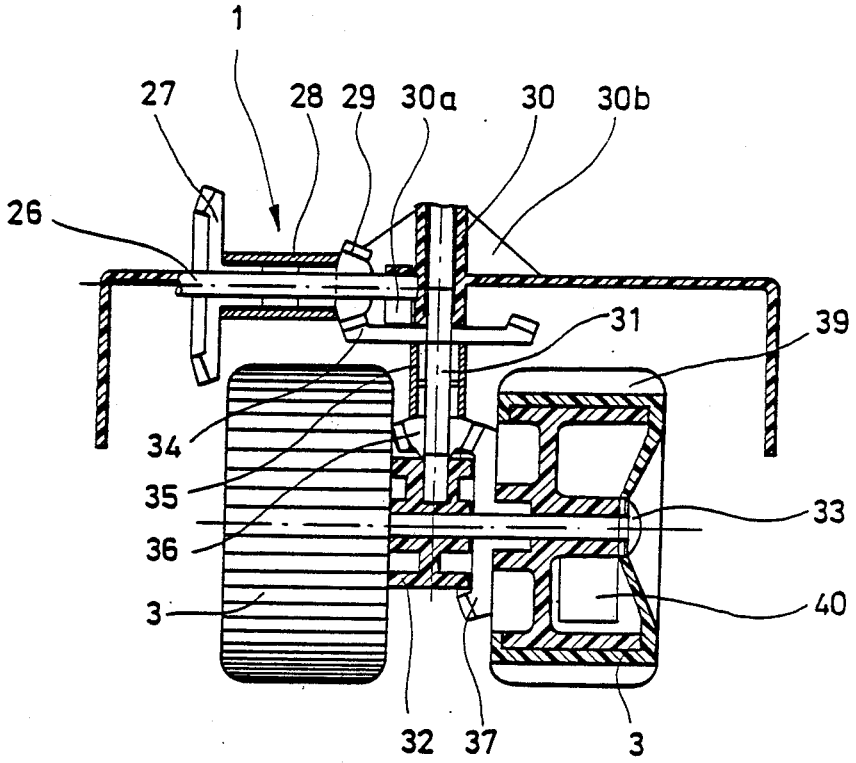
FIG. 5 shows a partial section view at the level of the front axle of the suction head showing the suction head from the front, without rotary plate.
Figure 6:
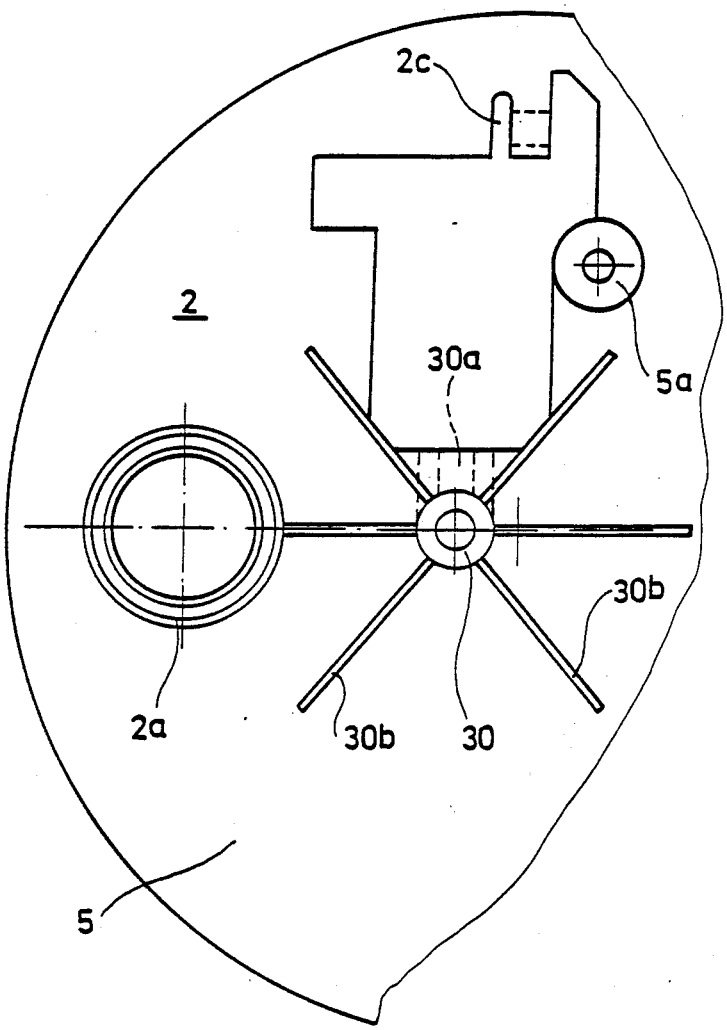
FIG. 6 shows a cutout of the housing in the front area of it.

Reference is made to FIG. 5 to explain further details. The rotary rod 31 is fixedly mounted in a rotary head 32, in which a front axle shaft 33 is rotatably mounted, which supports the front wheels 3 at close mutual distance. The front wheels 3 may be mounted on the front axle shaft 33 freely running or may be connected for co-rotation with each other or one of the front wheels is fixedly fastened on the shaft for co-rotation therewith, and the other via a slip clutch. A sixth bevel gearwheel 34 is rotatably mounted on the rotary rod 31, which is connected to a seventh bevel gearwheel 36 for co-rotation therewith by means of a sleeve 35. The seventh bevel gearwheel 36 is located above the rotary head 32 and meshes with an eighth bevel gearwheel 37 which is connected with one of the front wheels 3, in the present example with the left front wheel for co-rotation therewith.

Figure 3:
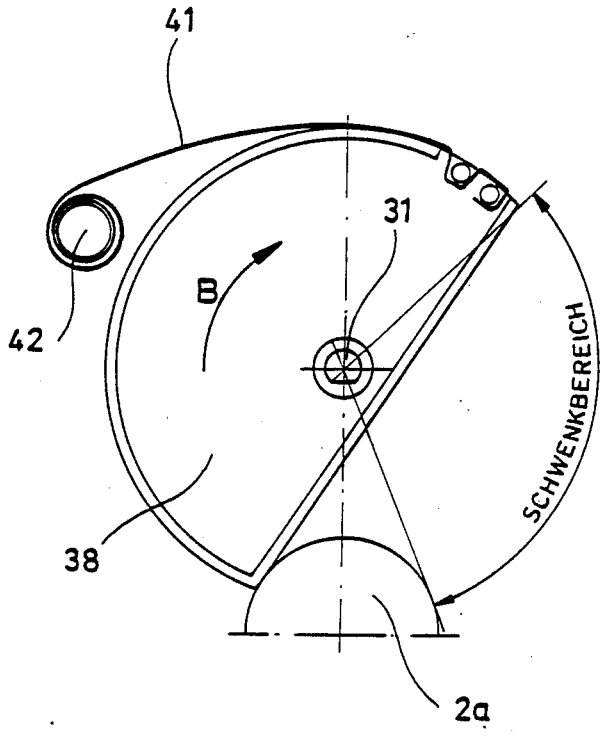
FIG. 3 shows a detail of the resetting means.

An approx. semicircular disk 38 (cf. FIG. 3) is fixedly fastened to the upper end of the rotary rod 31, at which a flat spiral spring 41 is anchored which is moreover wound around a journal 42, which is inserted lockingly in a console **5*a* projecting from the suction head housing 2. This flat spiral spring 41 keeps the rotary head 32 in a defined rest position in which the front axle shaft 33 has a predetermined alignment with respect to the rear axle rod 15. The rest position is determined by the stop of the semicircular disk 38 at the hollow connecting piece 2*a* and can be adjusted by an eccentric bush 43 inserted on the hollow connecting piece 2*a*, at which the disk 38 abuts in its end positions. The hollow connecting piece 2*a* is slightly conical at the outside so that the eccentric bush 43** can be clamped to it. The spring unwinds itself from the journal.

As is revealed by the drawings some of the elements are disposed above the cover plate 5 or traverse the same, but are covered by the rotary plate 8. It is therefore understood that the rotary plate 8 is suitably hollowed at its lower side to receive this element, e.g. the bush 30, the flat spiral spring 31, the console **5*a* with the journal 42 and the bevel gearwheels 27 and 29**.

The mentioned sleeves 24, 28 and 35 which serve for the axial connection of bevel gearwheels consist preferably of plastic material and receive the axle stub formed at the bevel gearwheels with pressing force. This type of construction permits the use of commercially available bevel gearwheels which reduces the price of the production of the suction head considerably. The inner cross-section of the sleeves is preferably angular, e.g. hexagonal and the axle stubs of the bevel gearwheels have preferably a profile adapted thereto to establish a form closure between sleeves and axle stubs. It is possible by means of the invention to produce the sleeves from material sold by the meter which simplies production to a great extent. The bevel gearwheels consist preferably of plastic material. The same applies to the rotary head 32 and the wheels 3 and 4. They can be filled with weight bodies 40 to impart the suction head 1 a low centre of gravity which prevents a tilting, favours a self-scending and produces the friction pressure necessary for propulsion. The wheels, in particular the front wheels 3 are suitably provided with tires 39, whose material is selected in such fashion that optimum friction properties for the propulsion of the suction head result with the swimming pool materials coming into question, e.g. ceramics plates, polyester, polyvinyl chloride, concrete. The transmission formed by the bevel gearwheels is on the whole a step-down gear with a step-down ratio of about 40:1 to about 20:1.

The performance of the suction head 1 in a swimming pool flooded with water is explained in the following. The suction head 1 is located at the bottom of the swimming pool. A flexible suction tube not represented here is connected to its connecting pipe 7. Water is sucked in from a suction pump also not represented here by means of this suction tube. The water enters through the inlet opening 18 in the nozzle into the turbine housing formed in the suction head housing 2 and flows through the same in an almost straight path in the direction towards the suction connecting pipe 7 and drives the blades of the turbine wheel 21 in the direction of rotation drawn in FIG. 2*a* with the arrow A.

The rotation of the turbine wheel 21 is transmitted via the first bevel gearwheel 22 to the second bevel gearwheel 23 which transmits its rotational movement via the sleeve 24 to the third bevel gearwheel 25. Said bevel gearwheel 5 meshes with the fourth bevel gearwheel 27, which is connected with the fifth bevel gearwheel 29 via the sleeve 28. The fifth bevel gearwheel 29 converts by means of the sixth bevel gearwheel 34 the rotation about the horizontal axis to a rotation about a vertical axis, namely about that of the rotary rod 31. The seventh bevel gearwheel 36 is driven by the sixth bevel gearwheel 34 via the sleeve 35 which meshes with the eighth bevel gearwheel 37 connected to the left front wheel in a manner as to prevent rotation. A positive driving connection from the turbine shaft 14 to the left front wheel 3 and via the front wheel shaft 33 possibly also to the right front wheel results in this fashion, depending upon the fact whether the same is connected to the front wheel shaft 33 in a fixed manner or via a unidirectional or a slip clutch. The suction head 1 is driven in forward direction. Depending upon the adjustment of the eccentric bush 43 it drives straight or with a curve over the bottom of the swimming pool. If it bumps against an obstacle with its rotary plate 8, the rotation of the front wheel 3 is stopped. The same also occurs, if the front wheel 3 bumps against an obstacle such as a stone. Since meanwhile the turbine wheel 21 is still driven by the water flow which flows through the turbine housing and this rotational movement is transmitted up to the seventh bevel gearwheel 36, the seventh bevel gearwheel 36 pivots the rotary head 32 due to the blocked eighth bevel gearwheel 37 together with the front axle shaft 33 supported by it about the axis of the rotary rod 31 in clockwise direction seen from above as is shown by the arrow B in FIG. 4. The entire suction head therefore evades to the right, the rotary plate 8 mounted freely rotatably at the suction head housing rolls off at the obstacle. Since the blocking effect between the seventh and the eighth bevel gearwheel 36 and 37 is maintained to a certain extent during the curve drive at the obstacle, and the flat spiral resetting spring 41 develops not a too great resetting force, the suction head 1 carries out a pivotal movement due to the bumping against the obstacle which encloses an angle with the previous direction of movement, which can be by far greater than 90°. The extent of the deflection and the speed of its resetting can be determined by the selection of the resetting spring force; one can also achieve that the suction head carries out a complete reversal. If the gearwheel arrangement at the front wheels and the resetting mechanism are designed laterally reversed, a deflection of the suction head towards the left is effected.

To facilitate the turning of the suction head at an obstacle the front area of the suction head housing 2 should be designed more narrowly than the rear area as represented here and the rotary plate 8 should have a sufficient projection.

Modifications can be effected at and further features can be implemented in the suction head according to the invention without leaving the spirit of the invention. It is of particular advantages to provide break-throughs in the cover plate 5 of the suction head housing 2 in order to facilitate the escape of any air possibly entrapped under the suction head 1 during immersing into water. These break-throughs may e.g. be laterally formed in a recessed section of the cover plate 5, where the catch 17 is formed for the elastic holding means of the lower turbine housing part 12, cf. FIG. 2*a*. For reasons of production engineering it may further be advantageous to provide break-throughs for parts of the injection moulding tool in the dome-like prominence 6 above the bearing halves 13*a* which are formed at the upper turbine housing part 12 with which the suction head housing 2 is injection moulded. Thus these break-throughs serve also for deaeration.

The resetting spring arrangement may possibly also contain two resetting springs which urge the rotary head into a predetermined rest position. In this case a stop for defining the rest position may be renounced and the suction head can possibly carry out a lurching movement as a function of the nature of the bottom on which it drives.

Figure 7:
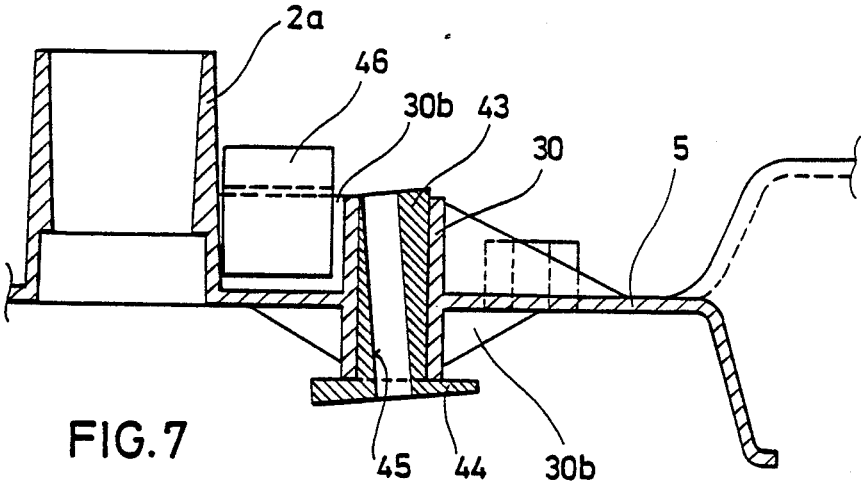
FIG. 7 shows a cutout of the housing as a sectional view showing an alternative embodiment of a rotary head bearing and FIG. 8 shows an alternative embodiment of a stop means for the rotary head.

An alternative embodiment for the mounting of the rotary head is shown in FIG. 7 as a cutout view. In this embodiment an inner bush 43 rests in the vertically extending bush 30 formed integrally with the suction head housing 2, which has a stop in the form of a collar 44 at its lower end. This inner bush 43 has a bore 45 whose axis is obliquely forwardly inclined from the vertical and is determined to receive the rotary rod 31 of the rotary head 32. The inner bush 43 is secured in the bush 30 against rotation, e.g. by a fit dimensioned in suitably narrow fashion.

The result of the oblique position of the axis of the bore 45 of the inner bush 43 with respect to the vertical is that upon the bumping of the suction head against an obstacle the rotary head 32 is rotated about an axis extending obliquely to the vertical so that one of the wheels 3 mounted on the rotary head, in the present case the right wheel loses its bottom adherence. Due to this the frictional resistance of the wheels at the bottom which could hinder a pivoting of a rotary head 32 due to the rigid coupling of the wheels 3 at the front wheel axle shaft 33 is reduced. However, it is ensured in the case of a straight drive of the suction head that both wheels have bottom adherence. The mentioned oblique position also favours the resetting of the rotary head after the passing of the obstacle.

The embodiment according to FIG. 7 makes it furthermore possible to select a material optimum for bearing purposes for the inner bush 43, which has mostly an increased price irrespective of the material of the suction head housing 2.

Figure 8:
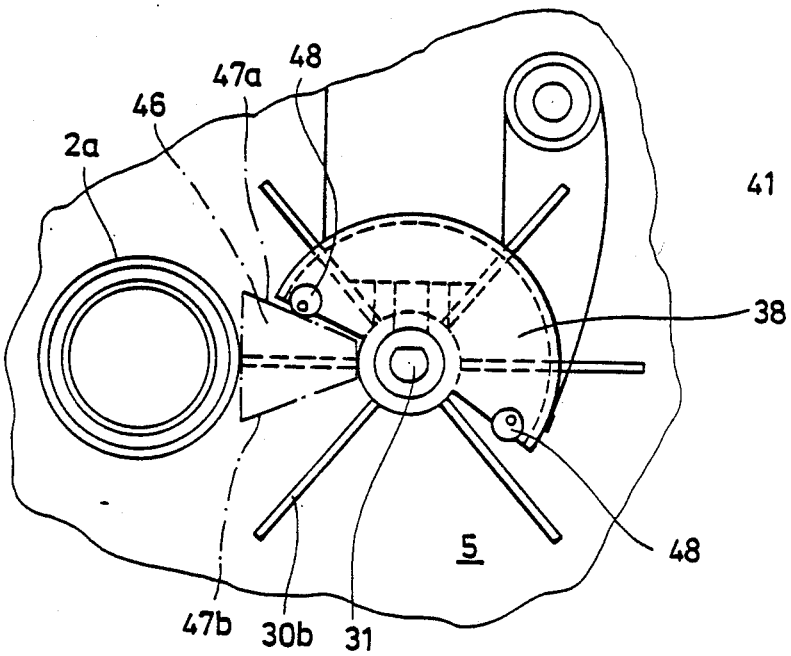

FIG. 7 and still better FIG. 8 show a second embodiment of an adjustable stop means. According to this embodiment a plug-in element 46 is slipped on one of the ribs 30*b* which support the bush 30 at the cover plate 5 of the suction head housing 1, in the present case on a rib 30*b* disposed between the bush 30 and the hollow connecting piece 2*a* which supports the rotary plate 8, which is provided with a slot at its lower side, which has, seen from the above, an approximately trapezoidal form as is shown by FIG. 8. The side surfaces 47*a* and 47*b* of the plug-in element 46 which extend obliquely form stop surfaces for the approximately semicircular disk 38 which is fastened to the rotary rod in a manner as to transmit rotation and is biased by the spring 41 in the direction to a rest position as it is shown in FIG. 8. This plug-in element may be produced as a exchange element, it being possible that the angles which form the two obliquely extending side surfaces 47*a* and 47*b* with a plane defined by the aforementioned slot are different for different plug-in elements 46 to define the rotational position of the rotary head 32 in the rest position and in the position deflected to a maximum. The two surfaces 47*a* and 47*b* extending obliquely need not extend symmetrically to each other as represented in FIG. 8, an asymmetrical design is likewise conceivable depending upon the rotary angles in the aforementioned end positions.

FIG. 8 shows moreover a further possibility of influencing the rotary angle positions of the rotary head. For this purpose eccentric plates 48 are screwed onto the approximately semicircular disk 38 adjacent to the approximately radially extending edges of said disk 38, which rest against the associated stop surfaces 47*a* or 47*b* of the plug-in element 46 in the end positions of the rotary head and thus of the disk 38. The corresponding angular positions can be adjusted by loosening the screws securing eccentric plates 48 at the disk 38 and rotating the eccentric plates 48.

I claim:

1. A suction head for the cleaning of submerged surfaces, in particular the bottoms of swimming pools which consists of a housing open at the lower side to which at least one front steerable wheel and rear wheels are rotatably mounted, a water-driven turbine disposed in the housing comprising a turbine chamber with an inlet opening facing the lower side of the housing, a rotatable connecting pipe traversing the upper side of the housing for connection to a suction tube and a turbine wheel rotatably mounted in the turbine chamber which drives said at least one front wheel via transmission means, wherein the turbine wheel comprises a horizontal rotational axis, the turbine chamber consists of an upper housing part integrally connected to the suction head housing and into which the connecting pipe ends, and a lower housing part linked to the suction head housing and in which the inlet opening is formed, the lower housing part being held by a detachable elastic locking means in a position closing the turbine chamber, and wherein the axis of the turbine wheel is in the separating line of the turbine housing parts so that the turbine wheel is freely accessible when said turbine chamber is opened upon detaching said elastic locking means, and the inlet opening and the connecting pipe are in one line extending approximately as a chord with respect to the rotary circle of the turbine wheel.

2. A suction head according to claim 1 wherein the lower turbine housing part and the rear wheels of the suction head are mounted on a joint axle rod.

3. A suction head according to claim 1, wherein:

(a) said at least one front wheel of the suction head has an axle shaft which is mounted in a rotary head mounted in the suction head housing pivotable about an axis extending approximately vertically to the direction of movement of the suction head and vertically to the axle shaft by more than 90° to one side;

(b) the rotary head is biased by a resetting spring arrangement in a rest position in which said axle shaft supported by it is aligned at a predetermined angle to the axis of the rear wheels;

(c) said transmission means comprise a toothed gearing, which contains at least one pair of bevel gearwheels, a bevel gearwheel of which rotates in the pivot axis of the rotary head and the other bevel gearwheel meshing with it is connected for co-rotation to the at least one front wheel; and (d) said front wheel is provided with a running surface which has a high coefficient of adhesion and sliding friction.

4. A suction head according to claim 3, wherein the resetting spring arrangement contains at least one flat spiral spring.

5. A suction head according to one of the claims 3 and 4, wherein a rotary rod extending in the pivot axis of said rotary head is connected to the rotary head for co-rotation therewith, a stop element determining the rest position of the rotary head and its position of maximum deflection being fixedly secured to said rotary head.

6. A suction head according to claim 3, wherein said toothed gearing comprises a plurality of pairs of bevel gearwheels, wherein some of said bevel gearwheels not forming a pair are connected with each other by means of sleeves, into which journals formed at said bevel gearwheels engage in form-fit and non-positive fashion.

7. A suction head according to claim 6, wherein the toothed gearing comprises a bent axle rod rotationally supporting bevel gearwheels and fixed to the suction head housing by locking fastening elements.

8. A suction head according to any one of claims 1 to 4, wherein a rotary plate is mounted freely rotatably at the housing and projects beyond the front housing part towards the front and towards the side.

9. A suction head according to claim 8, wherein the rotary plate projects beyond the suction head housing across an arc of at least 180°.

10. A suction head according to claim 9, wherein the rotary plate is rotatably mounted by means of a locking connection on a hollow connecting piece integrally connected to the suction head housing and projecting upwardly therefrom.

11. A suction head according to claim 8, wherein the rotary plate is rotatably mounted by means of a locking connection on a hollow connecting piece integrally connected to the suction head housing and projecting upwardly therefrom.

12. A suction head according to claim 11, wherein an eccentric plate is clamped onto the hollow connecting piece and forms a counter-stop for the stop element.

13. A suction head according to claim 12, wherein a plug-in element of trapezoidal cross-section which has counter-stop surfaces for the stop element is affixed to the suction head housing.

14. A suction head according to claim 5, wherein the stop element is a sector-shaped disk having radially extending edges and having said spring anchored to its circumference.

15. A suction head according to claim 14, wherein eccentric plates are adjustably fastened to the sector-shaped disk in the area of the radially extending edges thereof, and whose contours can be adjusted beyond said edges.

16. A suction head according to claim 14, wherein a plug-in element of trapezoidal cross-section which has counter-stop surfaces for the stop element is affixed to the suction head housing.

17. A suction head according to claim 5, wherein a plug-in element of trapezoidal cross-section which has counter-stop surfaces for the stop element is affixed to the suction head housing.

18. A suction head according to any one of claims 1 to 4, comprising two steerable front wheels fixed on a joint axle shaft for co-rotation, the pivot axis of the rotary head being slightly forwardly inclined against the vertical.

19. A suction head according to claim 18, wherein the suction head housing has a cover plate which is traversed by a bush integrally formed with said housing, an inner bush being firmly disposed in the bush and having a bore whose axis extends in slightly inclined fashion against the vertical towards the front side of the suction head, said bore defining the pivot axis of the rotary head.

20. A suction head according to claim 19, wherein the inner bush consists of material different from that of the suction head housing and specially suited for bearing purposes.

* * * * *